US007296462B2

(12) United States Patent
Gregory et al.

(10) Patent No.: US 7,296,462 B2
(45) Date of Patent: Nov. 20, 2007

(54) MULTI-PURPOSE DOWNHOLE TOOL

(75) Inventors: Gilbert N. Gregory, Sugar Land, TX (US); David E. Ball, Meadows Place, TX (US); Russell Scott Somers, Tomball, TX (US); Jeffrey L. Grable, Houston, TX (US); Clive D. Menezes, Conroe, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 102 days.

(21) Appl. No.: 11/121,332

(22) Filed: May 3, 2005

(65) Prior Publication Data

US 2006/0248949 A1 Nov. 9, 2006

(51) Int. Cl.
*E21B 43/00* (2006.01)

(52) U.S. Cl. ..... 73/152.51; 166/250

(58) Field of Classification Search ..... 73/152.27, 73/152.36, 152.22, 152.51, 152.26, 152.46, 73/152.52, 152.54, 52.51, 152.01; 166/250.01, 166/250, 250.02

See application file for complete search history.

(56) References Cited

U.S. PATENT DOCUMENTS 3,577,781 A * 5/1971 Lebourg et al. ..... 73/152.26
4,936,139 A * 6/1990 Zimmerman et al. .... 73/152.26
5,337,821 A * 8/1994 Peterson ..... 166/250.07
5,549,159 A * 8/1996 Shwe et al. ..... 166/250.02
5,991,602 A * 11/1999 Sturm ..... 455/40
6,305,470 B1 * 10/2001 Woie ..... 166/250.02
6,427,530 B1 * 8/2002 Krueger et al. ..... 73/152.46

* cited by examiner

*Primary Examiner*—Hezron Williams
*Assistant Examiner*—Rodney Frank
(74) *Attorney, Agent, or Firm*—Conley Rose, P.C.

(57) ABSTRACT

A multi-purpose downhole tool comprising packers for isolating an interval of a downhole formation traversed by a borehole to form a packed-off interval annulus. The tool further comprises a reversible pump and more than one interval access port located between the packers. The ports provide fluid communication with fluid in the packed-off interval annulus. The tool further comprises a fluid conduit system and valves for controlling fluid communication between the interval access ports and the reversible pump. The multi-purpose tool is capable of pumping from the packed-off interval annulus as well as pumping into or "through" the packed-off interval annulus for determining formation pressures as well as introducing well enhancement fluids downhole.

32 Claims, 8 Drawing Sheets

MULTI-PURPOSE DOWNHOLE TOOL

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND

During the drilling and completion of oil and gas wells, it may be necessary to engage in ancillary operations, such as monitoring the operability of equipment used during the drilling process or evaluating the production capabilities of formations intersected by the wellbore. For example, after a well or well interval has been drilled, zones of interest are often tested to determine various formation properties such as permeability, fluid type, fluid quality, formation temperature, formation pressure, bubblepoint, formation pressure gradient, mobility, filtrate viscosity, spherical mobility, coupled compressibility porosity, skin damage (which is an indication of how the mud filtrate has changed the permeability near the wellbore), and anisotropy (which is the ratio of the vertical and horizontal permeabilities). These tests are performed in order to determine whether commercial exploitation of the intersected formations is viable and how to optimize production.

Drill stem testers (DST) and wireline formation testers (WFT) have been commonly used to perform these tests. The basic DST tool consists of a packer or packers, valves, or ports that may be opened and closed from the surface, and two or more pressure-recording devices. The tool is lowered on a work string to the zone to be tested. The packer or packers are set, and drilling fluid is evacuated to isolate the zone from the drilling fluid column. The valves or ports are then opened to allow flow from the formation to the tool for testing while the recorders chart static pressures. A sampling chamber traps formation fluid at the end of the test. WFTs generally employ the same testing techniques but use a wireline to lower the test tool into the borehole after the drill string has been retrieved from the borehole. WFTs typically use packers also, although the packers are typically placed closer together, compared to DSTs, for more efficient formation testing. In some cases, packers are not even used. In those instances, the testing tool is brought into contact with the formation and testing is done without zonal isolation.

WFTs may also include a probe assembly for engaging the borehole wall and acquiring formation fluid samples. The probe assembly may include an isolation pad to engage the borehole wall. The isolation pad seals against the formation and around a hollow probe, which places an internal cavity in fluid communication with the formation. This creates a fluid pathway that allows formation fluid to flow between the formation and the formation tester while isolated from the borehole fluid.

With the use of DSTs and WFTs, the drill string with the drill bit must first be retracted from the borehole. Then, a separate work string containing the testing equipment, or, with WFTs, the wireline tool string, must be lowered into the well to conduct secondary operations.

DSTs and WFTs may also cause tool sticking or formation damage. There may also be difficulties of running WFTs in highly deviated and extended reach wells. WFTs also do not have flowbores for the flow of drilling mud, nor are they designed to withstand drilling loads such as torque and weight on bit.

Further, the formation pressure measurement accuracy of drill stem tests and, especially, of wireline formation tests may be affected by mud filtrate invasion and mudcake buildup because significant amounts of time may have passed before a DST or WFT engages the formation after the borehole has been drilled. Mud filtrate invasion occurs when the drilling mud fluids displace formation fluid. Because the mud filtrate ingress into the formation begins at the borehole surface, it is most prevalent there and generally decreases further into the formation. When filtrate invasion occurs, it may become impossible to obtain a representative sample of formation fluid or, at a minimum, the duration of the sampling period must be increased to first remove the drilling fluid and then obtain a representative sample of formation fluid. Mudcake buildup occurs when any solid particles in the drilling fluid are plastered to the side of the wellbore by the circulating drilling mud during drilling. The prevalence of the mudcake at the borehole surface creates a "skin" that can affect the measurement results. The mudcake also acts as a region of reduced permeability adjacent to the borehole. Thus, once the mudcake forms, the accuracy of reservoir pressure measurements decreases, affecting the calculations for permeability and producibility of the formation. The mudcake should be flushed out of the formation before a true, uncontaminated sample of the fluid can be collected. Thus, it may be desirable to pump formation fluid that is contaminated with filtrate from the formation until uncontaminated connate fluid can be identified and produced.

Another testing apparatus is the formation tester while drilling (FTWD) tool. Typical FTWD formation testing equipment is suitable for integration with a drill string during drilling operations. Various devices or systems are used for isolating a formation from the remainder of the borehole, drawing fluid from the formation, and measuring physical properties of the fluid and the formation. Fluid properties, among other items, may include fluid compressibility, flowline fluid compressibility, density, resistivity, composition, and bubblepoint. For example, the FTWD may use a probe similar to a WFT that extends to the formation and a small sample chamber to draw in formation fluid through the probe to test the formation pressure. To perform a test, the drill string is stopped from rotating and moving axially and the test procedure, similar to a WFT described above, is performed.

After the testing of a well, it may be desirable to leave the testing string in place in the well and stimulate or otherwise treat the various formations of the well by pumping acids and other fluids into the formations. Well stimulation refers to a variety of techniques used for increasing the rate at which fluids flow out of or into a well at a fixed pressure difference. As used herein, the terms "stimulate", "stimulation", etc. are used in relation to operations wherein it is desired to inject, or otherwise introduce, fluids into a formation or formations intersected by a wellbore of a subterranean well. Typically, the purpose of such stimulation operations is to increase a production rate and/or capacity of hydrocarbons from the formation or formations. For example, stimulation operations may include a procedure known as "fracturing" wherein fluid is injected into a formation under relatively high pressure in order to fracture the formation, thus making it easier for hydrocarbons within the formation to flow toward the wellbore. Other stimulation operations include acidizing, acid-fracing, etc. Well treatment may include injecting such fluids as anti-emulsion fluid, etc.

BRIEF DESCRIPTION OF THE DRAWINGS

For a more detailed description of the embodiments, reference will now be made to the following accompanying drawings.

DETAILED DESCRIPTION OF THE EMBODIMENTS

Figure 1:
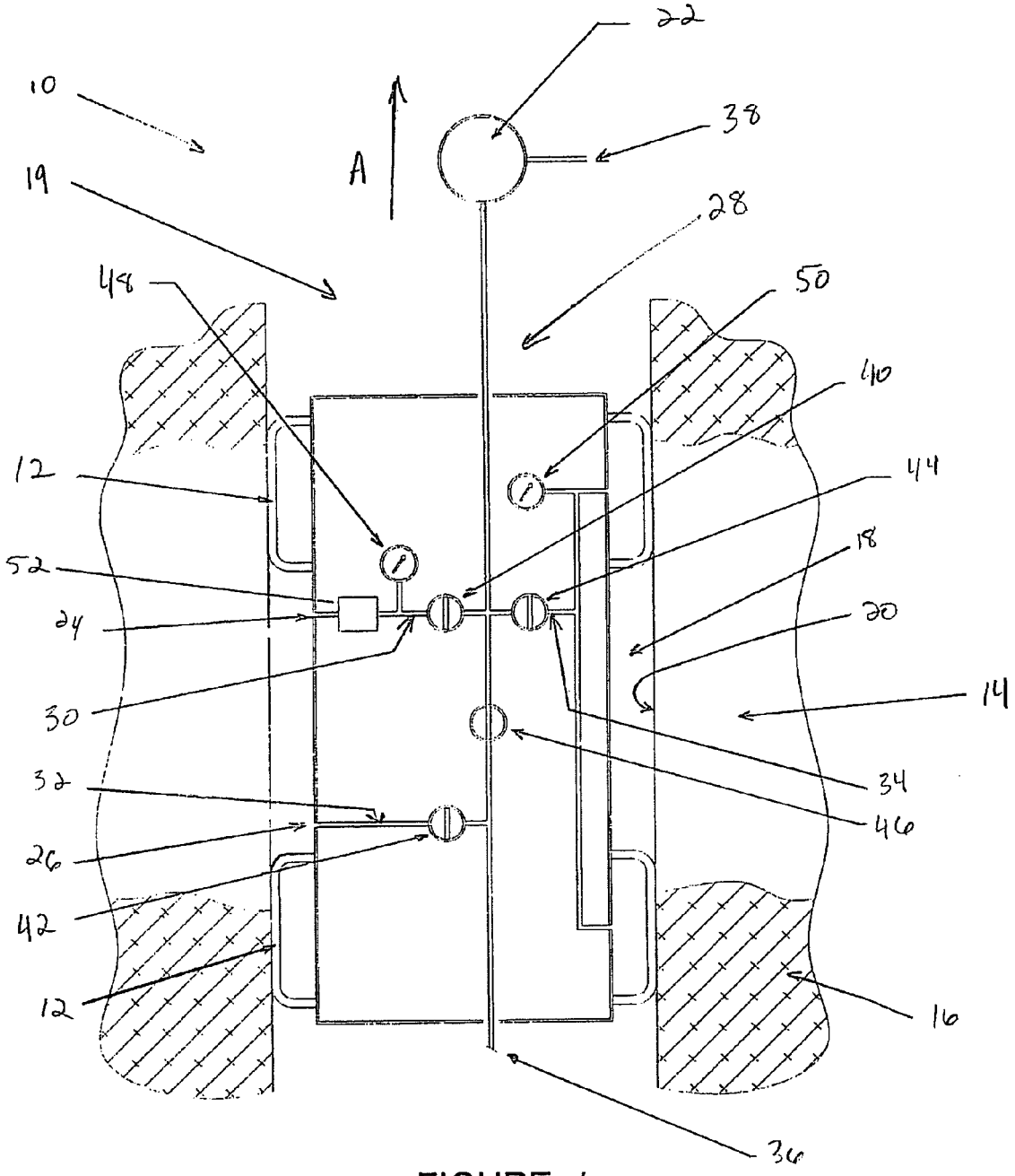
FIG. 1 is a schematic cross-sectional view of an embodiment of a multipurpose downhole tool.

In the drawings and description that follows, like parts are marked throughout the specification and drawings with the same reference numerals, respectively. The drawing figures are not necessarily to scale. Certain features of the invention may be illustrated exaggerated in scale or in somewhat schematic form and some details of conventional elements may not be illustrated in the interest of clarity and conciseness. The present invention is susceptible to embodiments of different forms. Specific embodiments are described in detail and are illustrated in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

FIGS. 1-5 illustrate a multi-purpose downhole tool 10 that may be conveyed downhole into a borehole 19 on either a wireline or a pipe string. The pipe string may comprise either a tubing string or a drill string where the tool 10 is conveyed downhole during drilling operations. Not illustrated in the figures is a control system for controlling the downhole tool 10 from the surface. The control system may comprise a processor located on the surface and capable of communicating with the tool 10 or located downhole in the tool 10. The processor gives instructions to a controller located downhole for operating the tool 10. The controller may be any suitable controller or controllers for operating the tool 10 as described below.

The tool 10 further comprises a pump 22. The pump 22 may be a centrifugal pump, a piston pump, or any other suitable type of fluid/gas pump. The pump 22 may also be a reversible pump such that flow through the pump 22 may be reversed without moving or changing the pump 22 itself. The pump 22 may be powered by any suitable means such as at least one of a power conduit through a wireline connection, downhole batteries, or a downhole generator.

As illustrated in FIG. 1, the tool 10 comprises packers 12 for isolating an interval 14 of a downhole formation 16 traversed by the borehole 19. The packers 12 may comprise what are commonly referred to as "straddle packers" because they "straddle" and isolate the desired interval 14 of the formation 16. The packers 12 may also be located any suitable distance apart from each other. As a non-limiting example, the packers 12 may be between one meter to thirty meters apart. However, the packers 12 may be other distances apart as well depending on the desired operating parameters of the tool 10. The tool 10 may also comprise more than two packers 12 for isolating more than one formation interval at one time. The packers 12 may also be made of any suitable material for forming a seal between the tool 10 and the borehole wall 20. As a non-limiting example, the packers 12 may be made of rubber. The packers 12 expand to form a seal against the borehole wall 20. To expand the packers 12, they may be "inflatable packers" that are expanded by filling the packers 12 using, e.g., borehole fluids, hydraulic fluids, or any other suitable type of inflation fluid. The packers 12 may alternatively be "compression-style" packers where the packers 12 are compressed along the longitudinal axis of the tool 10 to expand the packers 12 in the radial direction into sealing engagement with the borehole wall 20. For purposes of this application, the packers 12 will be described as inflatable packers. However, compression-style packers or a combination of inflatable and compression-style packers may also be used.

The tool 10 further comprises at least two interval access ports 24,26. The interval access ports 24,26 are located between the inflatable packers 12 and provide fluid communication between the tool 10 and the fluid within the packed-off interval annulus 18. Although only two interval access ports are illustrated, the tool 10 may comprise as many interval access ports 24,26 as appropriate for the operations of the tool 10.

Connecting the interval access ports 24,26 with the pump 22 is a fluid conduit system generally designated by numeral 28. The fluid conduit system 28 may comprise interval flowlines 30,32 to each interval access port 24,26. The fluid conduit system 28 may further comprise a packer flowline 34 providing fluid flow to each of the packers 12. The fluid conduit system 28 may further comprise a main flowline 36 connecting the interval flowlines 30,32 and the packer flowline 34 with the pump 22. The fluid conduit system 28 may further comprise a discharge line 38 that discharges fluid from the tool 10 to outside the packed-off annulus 18. Alternatively, the fluid in the discharge line 38 may be redirected with additional flowlines and valving to other tools or sections on the wireline or drillstring without being discharged to the borehole 19. The fluid conduit system 28 need not be configured exactly as illustrated in FIGS. 1-5 but may be arranged in any suitable configuration depending on the space and operation requirements of a particular application. Although not illustrated, the fluid conduit system 28 may further comprise a collection chamber such as the fluid collection chamber 54 illustrated in FIG. 6 for collecting fluids pumped from the packed-off interval annulus 18. The fluid collection chamber may also be releasably connected to the downhole tool 10. After fluid is collected into the chamber, the chamber may be closed and released from the tool 10 into the borehole 19 above the packed-off interval amiulus 18. The fluid collection chamber may then be pumped by fluid in the borehole to the surface.

Also within the fluid conduit system 28 are valves for controlling fluid flow within the fluid conduit system 28. As illustrated in FIGS. 1-5, the fluid conduit system 28 comprises interval flowline valves 40,42 for controlling fluid communication between the interval access ports 24,26 and the pump 22. The fluid conduit system 28 further comprises a packer flowline valve 44 for controlling fluid communication between the packers 12 and the pump 22. The fluid conduit system 28 further comprises a main flowline valve 46 for controlling fluid communication between the pump 22 and the interval flowline 32. The valves of the tool 10 may be any suitable type of valve for regulating flow through the fluid conduit system 28. Although the valves are illustrated in certain locations within the fluid conduit system 28, the valves may alternatively be located in any suitable location within the fluid conduit system 28.

The tool 10 also further comprises a sensor 48 for measuring the pressure of the fluid within the interval access flowline 30 and a sensor 50 for measuring the pressure of the fluid within the packer flowline 34. The tool 10 may further comprise a sensor 52 for measuring additional properties of the fluid in the interval flowline 30. For example, the sensor 52 may measure fluid resistivity or fluid temperature. The sensor 52 may measure other properties of the fluid in the interval flowline 30 as well. Alternatively, although not illustrated, the fluid conduit system 28 may comprise a cross-over flowline and a cross-over valve directing fluid from the interval flowline 32 to the interval flowline 30 to be measured by the sensors 48,52. Also alternatively, the tool 10 may comprise additional sensors 48,52 on each of the interval flowlines 30,32.

As illustrated in FIGS. 1-5, the interval access ports 24,26 are spaced apart in the axial direction of the tool 10 as designated by the direction arrow A. Alternatively, the interval access ports 24,26 may be spaced at the same level axially within the borehole 19. Additionally, although not illustrated, the interval access ports 24,26 may be spaced apart azimuthally around the tool 10 within the borehole 19. Alternatively, the interval access ports 24,26 may allow access azimuthally around the tool 10 for flowing fluid from azimuthally around the tool 10. Also alternatively, although only two access ports 24,26 are illustrated, alternative embodiments may have a plurality of access ports at a plurality of locations within the packed-off interval annulus 18.

Figure 2:
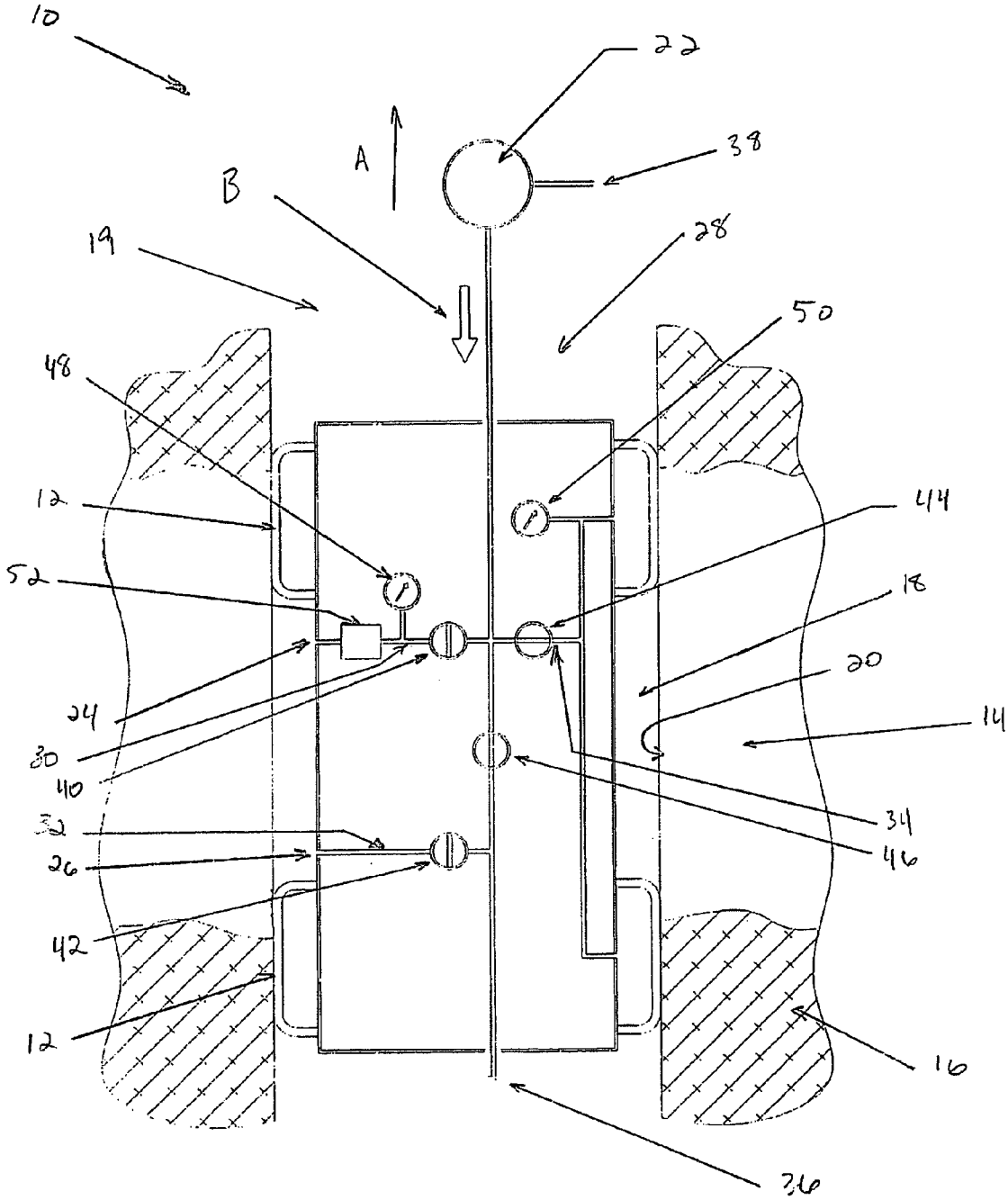
FIG. 2 is a schematic cross-sectional view of the embodiment of a multipurpose downhole tool of FIG. 1.

As illustrated in FIG. 2, the tool 10 is positioned at the interval 14 of the formation 16. Both the interval flowline valves 40,42 are closed and the packer flowline valve 44 is opened providing fluid communication between the main flowline 36 and the inside of the packers 12. Additionally, although not shown, a valve may close fluid flow through the main flowline 36 below the tool 10. The outlet of the pump 22 is then directed into the main flowline 36 as shown by direction arrow B and the packers 12 are inflated with fluid, e.g., from the borehole 19 pumped through discharge flowline 38. The packers 12 are inflated until they form a seal between the tool 10 and the borehole wall 20. When the desired inflation pressure is achieved, which is monitored by the sensor 50, the pump 22 is stopped and the packer flowline valve 44 is closed.

Figure 3:
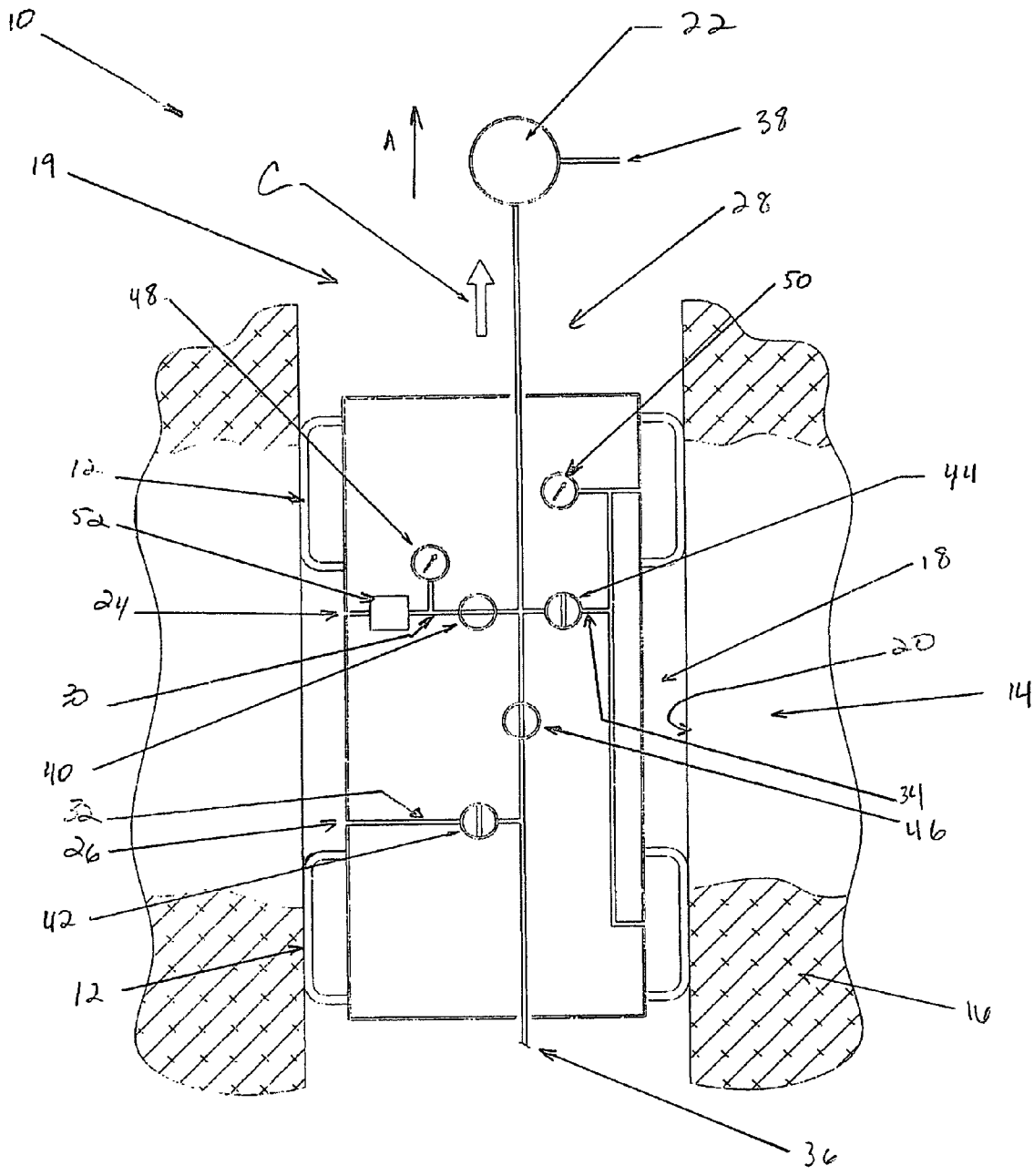
FIG. 3 is a schematic cross-sectional view of the embodiment of a multipurpose downhole tool of FIG. 1.

FIG. 3 illustrates fluid sampling through the interval access port 24. As illustrated, by opening the interval flowline valve 40 and by closing the interval flowline valve 42 and the packer flowline valve 44, only the interval access port 24 is connected to the inlet of the pump 22 through the fluid conduit system 28. Additionally, although not shown, a valve may close fluid flow through the main flowline 36 below the tool 10. Alternatively, the main flowline valve 46 may be closed instead of the interval flowline valve 42. The pump 22 is then started and fluid is extracted from the packed-off interval annulus 18 and eventually the formation interval 14 and through the interval access port 24. The fluid flows through the fluid conduit system 28 as illustrated by direction arrow C. The outlet of the pump 22 may be discharged to the borehole 19 through the discharge flowline 38. As fluid flows through the interval flowline 30, the interval flowline sensor 48 monitors, e.g., the resulting fluid pressure within the interval flowline 30. The sensor(s) 52 monitor other properties of the fluid flowing through the interval flowline 30. By way of non-limiting example, the sensor(s) 52 may monitor temperature, resistivity, or other fluid properties. When desired, the pump 22 may be stopped and the resulting "build-up" pressure may be monitored with the sensor 48. Also, if desired, the outlet of the pump 22 may be directed into a fluid sample chamber (not shown) for fluid collection and retrieval. The fluid collection chamber may also be releasably connected to the downhole tool 10. After fluid is collected into the chamber, the chamber may be closed and released from the tool 10 into the borehole 19 above the packed-off interval annulus 18. The fluid collection chamber may then be pumped by fluid in the borehole to the surface.

As illustrated, the interval access port 24 may be positioned close to the top of the packed-off interval. As a result, the fluid pumped through interval access port 24 may be the "lighter", or less dense, fluids from the interval annulus 18 such as gas or oil as opposed to water. However, the location of the interval access port 24 may vary depending on the configuration of the tool 10 and the density of the fluids pumped through the interval access port 24. Additionally, the variance of the density and resulting stratification of the fluids in the packed-off interval annulus 18 depends on the composition of the fluids in the particular packed-off interval annulus 18 at any given time.

Figure 4:
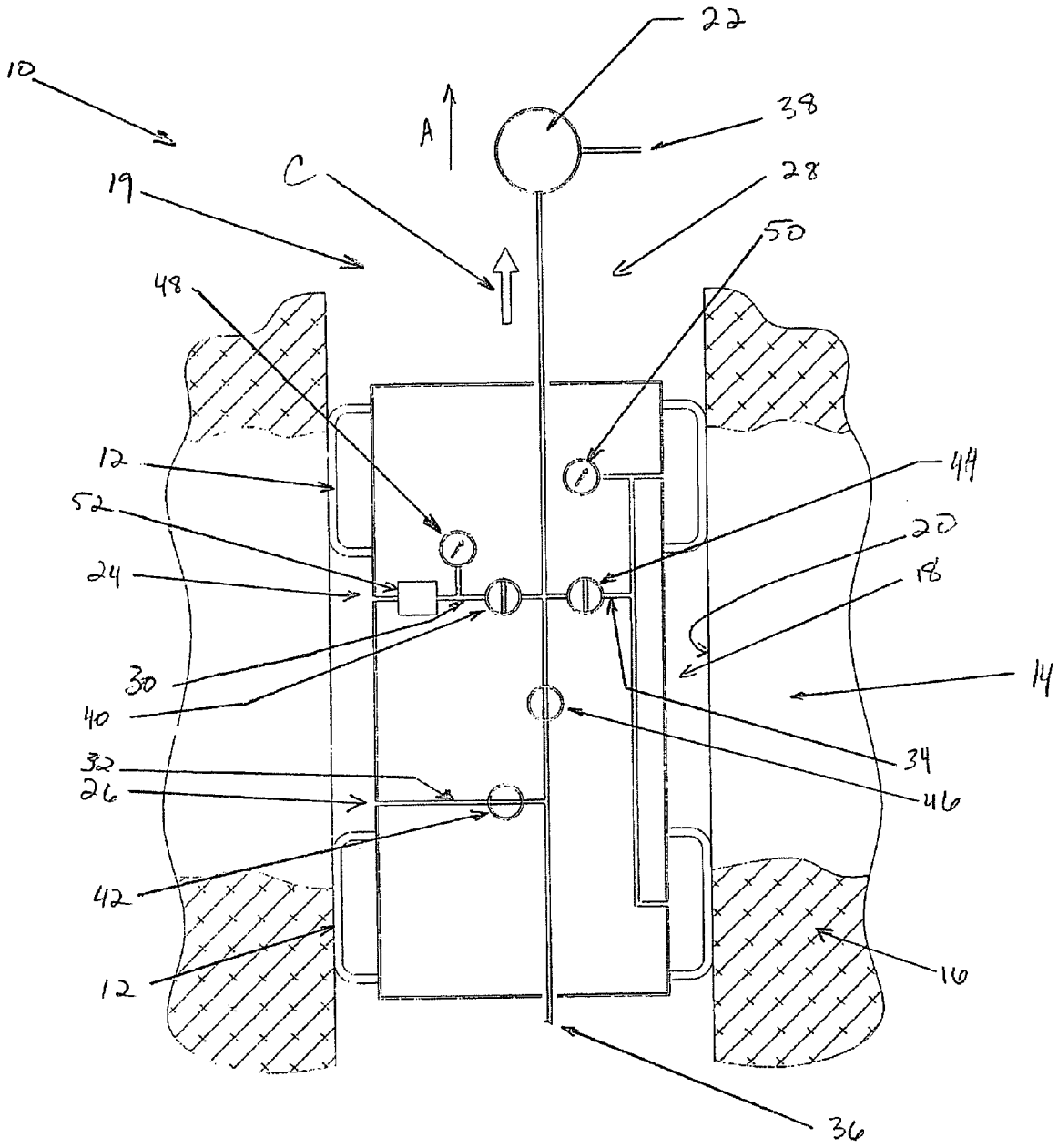
FIG. 4 is a schematic cross-sectional view of the embodiment of a multipurpose downhole tool of FIG. 1.

FIG. 4 illustrates fluid sampling through the interval access port 26. As illustrated, by opening the interval flowline valve 42 and the main flowline valve 46 and by closing the interval flowline valve 40 and the packer flowline valve 44, only the interval access port 26 is connected to the inlet of the pump 22 through the fluid conduit system 28. Additionally, although not shown, a valve may close fluid flow through the main flowline 36 below the tool 10. The pump 22 is then started and fluid is extracted from the packed-off interval annulus 18 and eventually the formation interval 14 and through the interval access port 26. The fluid flows though the fluid conduit system 28 as shown by direction arrow C. The outlet of the pump 22 may be discharged to the borehole 19 through the discharge flowline 38. The interval flowline 32 as illustrated may not include the sensor 48 or sensor(s) 52 for measuring the pressure and other properties of the fluid in the interval flowline 32. However, as described above, the tool 10 may comprise additional sensors 48,52 in the interval flowline 32 for measuring the pressure and other properties of the fluid in the interval flowline 32. Also alternatively, although not illustrated, the fluid conduit system 28 may comprise a cross-over flowline and a cross-over valve directing fluid from the interval flowline 32 to the interval flowline 30 to be measured by the sensors 48,52 in the interval flowline 30. When desired, the pump 22 may be stopped and the resulting "build-up" pressure may be monitored by the sensor 48. Also, if desired, the outlet of the pump 22 may be directed into a fluid sample chamber (not shown) for subsequent fluid collection and retrieval to the surface. The fluid collection chamber may also be releasably connected to the downhole tool 10. After fluid is collected into the chamber, the chamber may be closed and released from the tool 10 into the borehole 19 above the packed-off interval annulus 18. The fluid collection chamber may then be pumped by fluid in the borehole to the surface.

As illustrated, the interval access port 26 may be positioned close to the bottom of the packed-off interval. As a result, the fluid pumped through interval access port 26 may be the "heavier", or more dense, fluids from the interval annulus 18 such as oil or water as opposed to gas. However, the location of the interval access port 26 may vary depending on the configuration of the tool 10 and the density of the fluids pumped through the interval access port 26. Additionally, the variance of the density and resulting stratification of the fluids in the interval annulus 18 depends on the composition of the fluids in the particular interval annulus 18 at any given time.

Figure 5:
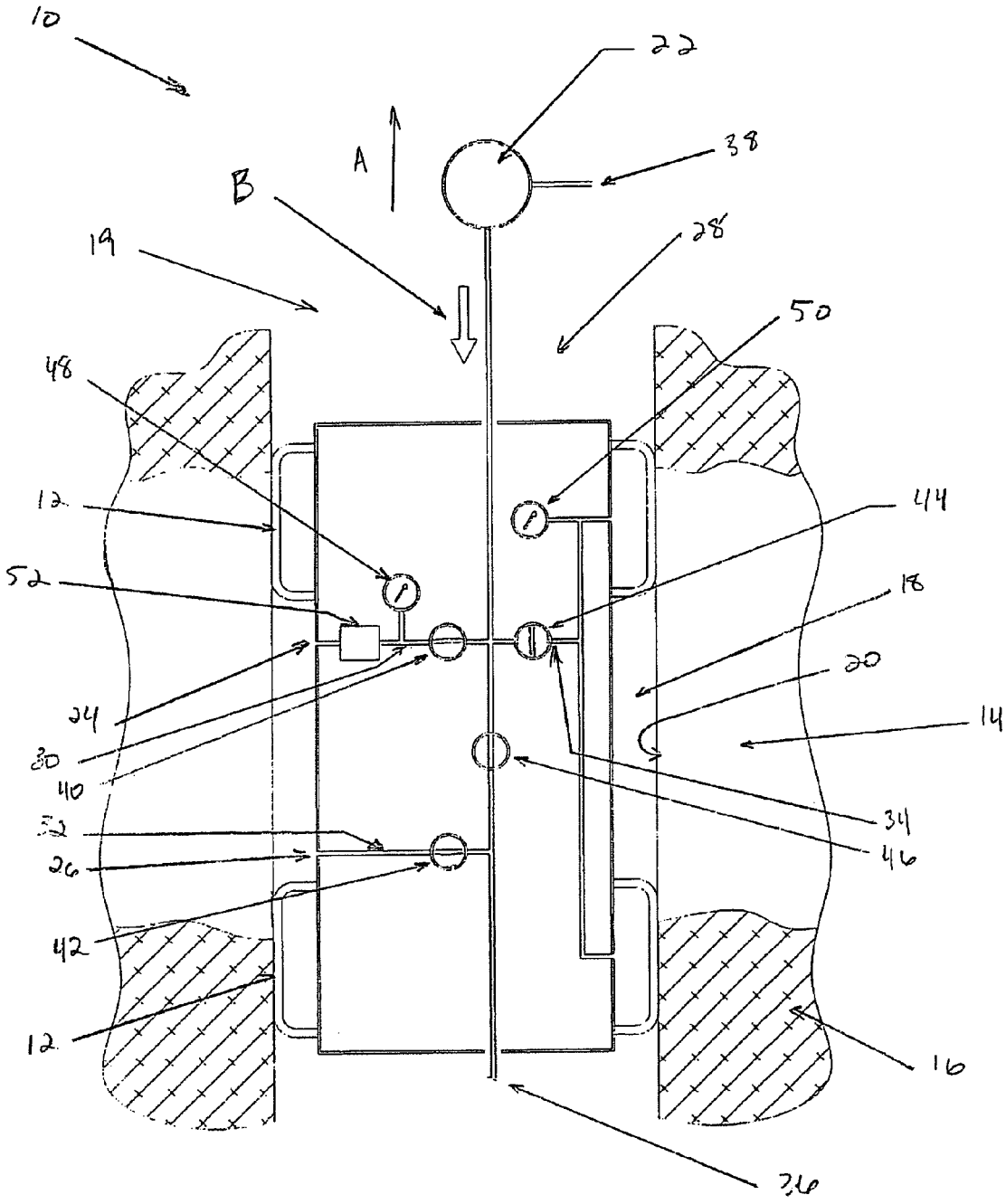
FIG. 5 is a schematic cross-sectional view of the embodiment of a multipurpose downhole tool of FIG. 1.

As illustrated in FIG. 5, the tool 10 may also operate to pump fluid into the packed-off interval annulus 18. As illustrated, by opening at least one of the interval flowline valves 40,42 and by closing the packer flowline valve 44, at least one of the interval access ports 24,26 is connected to the outlet of the pump 22 through the fluid conduit system 28. Additionally, although not shown, a valve may close fluid flow through the main flowline 36 below the tool 10. The pump 22 is then operated to extract fluid from the borehole 19 outside the packed-off interval annulus 18 through the discharge flowline 38, with the outlet of the pump 22 directed as shown with direction arrow B. The pump 22 pumps the fluid through at least one of the interval access ports 24,26 into the packed-off interval annulus 18. The pump 22 may then be stopped and the pressure of the fluid in at least one of the interval flowlines 30,32 may be monitored by sensor 48 or multiple sensors 48 in each interval flowline 30,32 as described above.

Figure 6:
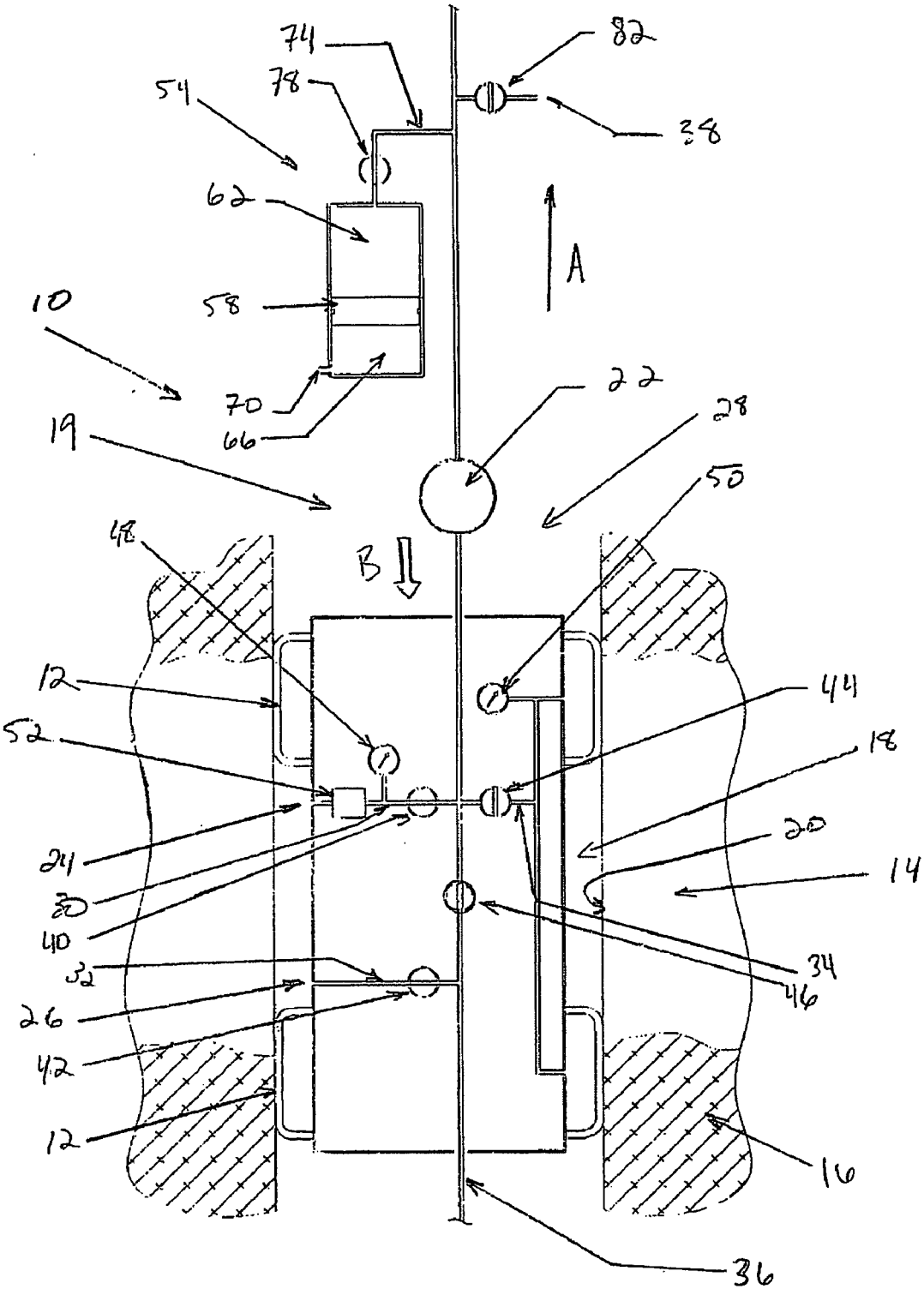
FIG. 6 is a schematic cross-sectional view of a first alternative embodiment of a multipurpose downhole tool.

Alternatively, as illustrated in FIG. 6, the tool 10 may operate to pump fluid into the packed-off interval annulus 18 from a fluid chamber 54. The embodiment illustrated in FIG. 6 is capable of performing the operations of the embodiment described above. Additionally, by opening at least one of the interval flowline valves 40,42 and by closing the packer flowline valve 44, at least one of the interval access ports 24,26 is connected to the outlet of the pump 22 through the fluid conduit system 28. The fluid chamber 54 comprises a piston 58 dividing the fluid chamber 54 into a first section 62 and a second section 66. The first section 62 may contain well enhancement fluid. As used herein, well enhancement fluid may comprise well stimulation or treatment fluid. The well enhancement fluid may be any suitable fluid such as a fracturing fluid, anti-emulsion fluid, or any other type of well enhancement fluid. The second section 66 may be open to the hydrostatic pressure of the borehole 19 through a port 70. The fluid conduit system 28 connects the fluid chamber 54 with the main flowline 36 through a chamber flowline 74. The fluid conduit system 28 further comprises a chamber valve 78 for controlling fluid flow into and out of the fluid chamber 54. The fluid conduit system 28 may further comprise a discharge valve 82 for controlling fluid flow through the discharge flowline 38.

With the outlet of the pump 22 set as shown by direction arrow B, the chamber valve 78 is opened and the discharge valve 82 is closed. Additionally, although not shown, a valve may close fluid flow through the main flowline 36 below the tool 10. The pump 22 is then started to pump well enhancement fluid from the fluid chamber 54, out of at least one of the interval access ports 24,26, and into the formation interval annulus 18. The pump 22 may then be stopped and the pressure of the fluid in at least one of the interval flowlines 30,32 may be monitored by sensor 48 or multiple sensors 48 in one or each of the interval flowlines 30,32 as described above. The sensor(s) 52 may also monitor other fluid properties in one or each of the interval flowlines 30,32 as described above. Alternatively, there may be more than one fluid chamber 54 and more than one pump 22 for pumping fluid into the packed-off interval annulus 18. The fluid chamber 54 may also be releasably connected to the downhole tool 10 for the retrieval of collected fluids. After fluid is collected into the chamber 54, the chamber 54 may be closed and released from the tool 10 into the borehole 19 above the packed-off interval annulus 18. The fluid chamber 54 may then be pumped by fluid in the borehole to the surface.

Figure 7:
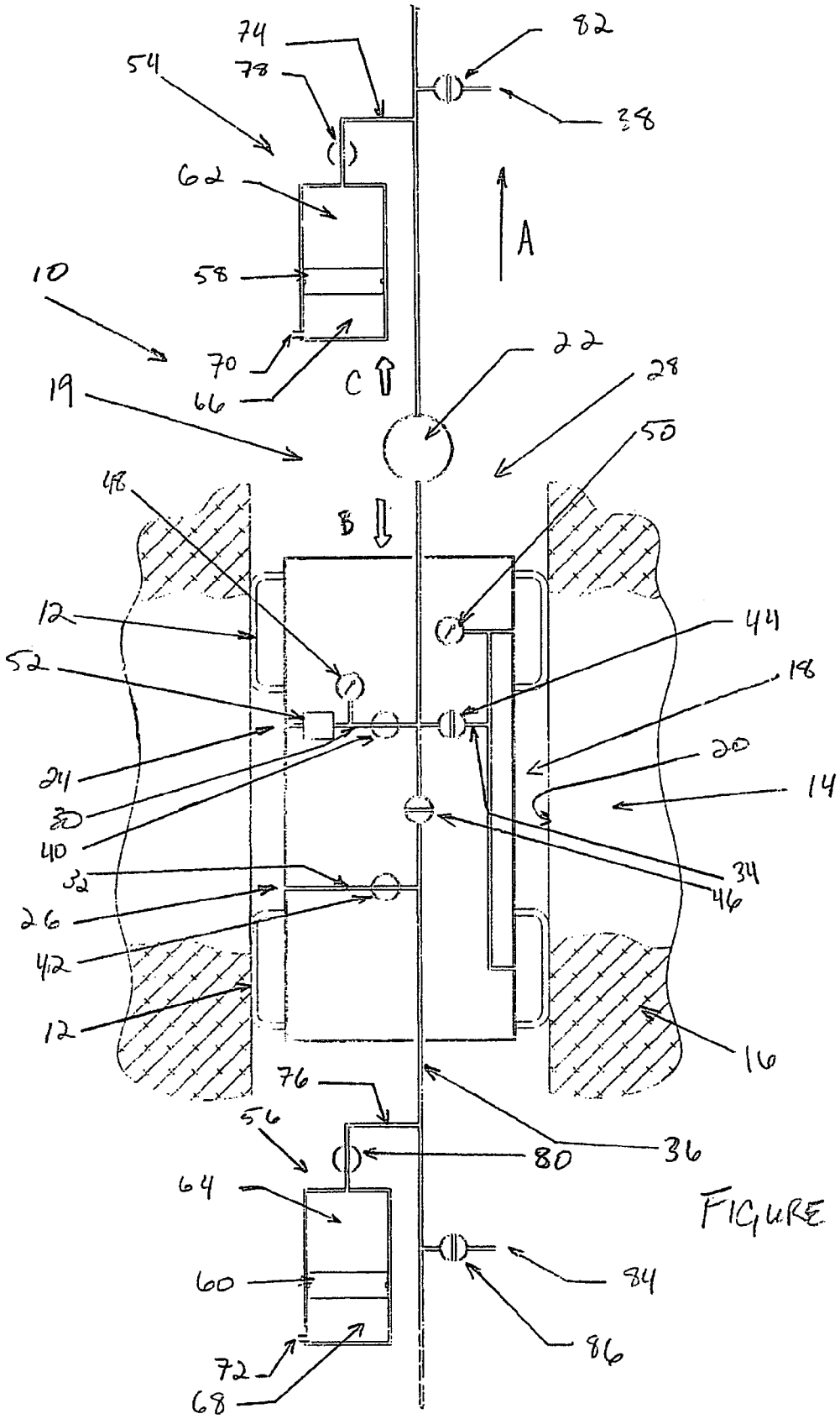
FIG. 7 is a schematic cross-sectional view of a second alternative embodiment of a multipurpose downhole tool.

Alternatively, as illustrated in FIG. 7, the tool 10 may operate to pump fluid "through" the packed-off interval annulus 18. The embodiment illustrated in FIG. 7 is capable of performing the operations of the embodiments described above. Additionally, by opening the interval flowline valves 40,42 and by closing the packer flowline valve 44, the interval access ports 24,26 are connected to the pump 22 through the fluid conduit system 28. The tool 10 may further comprise at least two fluid chambers 54,56 each comprising corresponding pistons 58,60 dividing the fluid chambers 54,56 into first sections 62,64 and second sections 66,68, respectively. The first sections 62,64 may contain well enhancement fluid. The well enhancement fluid may comprise well stimulation or treatment fluid. The well enhancement fluid may be any suitable fluid such as a fracturing fluid, anti-emulsion fluid, or any other type of well enhancement fluid. The second sections 66,68 may be open to the hydrostatic pressure of the borehole 19 through ports 70,72. The fluid conduit system 28 connects the fluid chambers 54,56 with the main flowline 36 through chamber flowlines 74,76. The fluid conduit system 28 further comprises chamber valves 78,80 for controlling fluid flow into and out of the fluid chambers 54,56, respectively. The fluid conduit system 28 further comprises a discharge valve 82 for controlling fluid flow through the discharge flowline 38. The fluid conduit system may further comprise an additional discharge flowline 84 and discharge valve 86 for controlling fluid flow through the discharge flowline 84.

With the outlet of the pump 22 set as shown by direction arrow B, the chamber valves 78,80 are opened, the discharge valves 82,86 are closed, and the main flowline valve 46 is closed. Additionally, although not shown, a valve may close fluid flow through the main flowline 36 below the tool 10. The pump 22 is started to pump well enhancement fluid from the fluid chamber 54, out of the interval access port 24, and into the formation interval annulus 18. The well enhancement fluid then flows "though" the packed-off interval annulus 18 and into the interval access port 26 where it then flows into the fluid chamber 56. The pump 22 may then be stopped and the pressure of the fluid in at least one of the interval flowlines 30,32 may be monitored by sensor 48 or multiple sensors 48 in one or each of the interval flowlines 30,32 as described above. The sensor(s) 52 may also monitor other fluid properties in one or each of the interval flowlines 30,32 as described above.

Additionally, the outlet of the pump 22 may be reversed to flow as illustrated by direction arrow C. The pump 22 is started to pump well enhancement fluid from the fluid chamber 56, out of the interval access port 26, and into the formation interval annulus 18. The well enhancement fluid then flows "though" the packed-off interval annulus 18 and into the interval access port 24 where it then flows back into the fluid chamber 54. The pump 22 may then be stopped and the pressure of the fluid in at least one of the interval flowlines 30,32 may be monitored by sensor 48 or multiple sensors 48 in one or each of the interval flowlines 30,32 as described above. The sensor(s) 52 may also monitor other fluid properties in one or each of the interval flowlines 30,32 as described above.

The reversible "flow through" process described above may be repeated as many times as desired. Alternatively, the tool 10 may comprise any number of the fluid chambers 54,56 with the fluid chambers 54,56 containing the same or different well enhancement fluids. Also, the tool 10 may comprise additional pumps 22 pumping fluid through the additional fluid chambers 54,56. At least one of the fluid chambers 54,56 may also be releasably connected to the downhole tool 10 for the retrieval of collected fluids. After fluid is collected into the chamber 54 and/or 56, the chamber 54 and/or 56 may be closed and released from the tool 10 into the borehole 19 above the packed-off interval annulus 18. The fluid chamber 54 and/or 56 may then be pumped by fluid in the borehole 19 to the surface.

With respect to all of the embodiments described, the sensors 48,50,52 may collect data on the operation of the tool 10, the annulus fluid, and/or the well enhancement fluid. This data may be stored locally within the tool 10 for retrieval once the tool 10 is removed from the borehole 19. Additionally or alternatively, all of the embodiments of the tool 10 may incorporate the use of at least one writeable and readable data storage unit, or data carrier 88, capable of flow within the borehole annulus from the tool 10 to the surface.

The at least one data carrier 88 is a data storage device that can be directly or remotely written to and read. The data carrier 88 preferably comprises a circuit including a data chip and an antenna encapsulated to protect circuit from the fluid flow. A suitable data carrier may be similar in construction to commercially available non-contact identification transponders, for example the AVID identity tags or AVID industrial RFID transponders available from AVID. These identity tags and transponders may comprise an integrated circuit and coil capacitor hermetically sealed in biocompatible glass. For example, the identity tags and transponders may only be 0.45 inches by 0.08 inches, weigh approximately 0.0021 oz., and carry 96 bits. The tag may not have an internal power source, and instead be powered by RF energy from a reader, which generates a 125 KHz radio signal. When the tag is within the electromagnetic field of the reader, the tag transmits its encoded data to the reader, where it can be decoded and stored. Typical read distances range from 4.125 inches (10 cm) to about 10.25 inches (26 cm), and read times are less than 40 msec. The data carrier 88 may also be any other suitable type of data storage device that can be directly or remotely written to and read.

The tool 10 also includes at least one writing device 90 for writing to the data carriers 88. The writing device 90 may directly write to the data carriers 88 or may be a remote writing device that remotely writes data to the data carriers 88. The data carriers 88 also interact with a reading device 92 for reading the data carriers 88. The reading device 92 may directly read the data from the data carriers 88 or may be a remote reading device for remotely reading the data carriers 88 as they pass the reading device 92.

The data written on the data carriers 88 may also include ordering or sequencing data as well as information data, so that the information data can be properly reassembled. Because spacing between the data carriers 88 can vary, and in fact the data carriers 88 can arrive at the reading device 92 out of sequence, the ordering or sequencing information allows the data to be reassembled correctly. The data may also be redundantly written on at least two data carriers 88, to reduce the risk of lost data if some data carriers 88 become lost or damaged.

Figure 8:
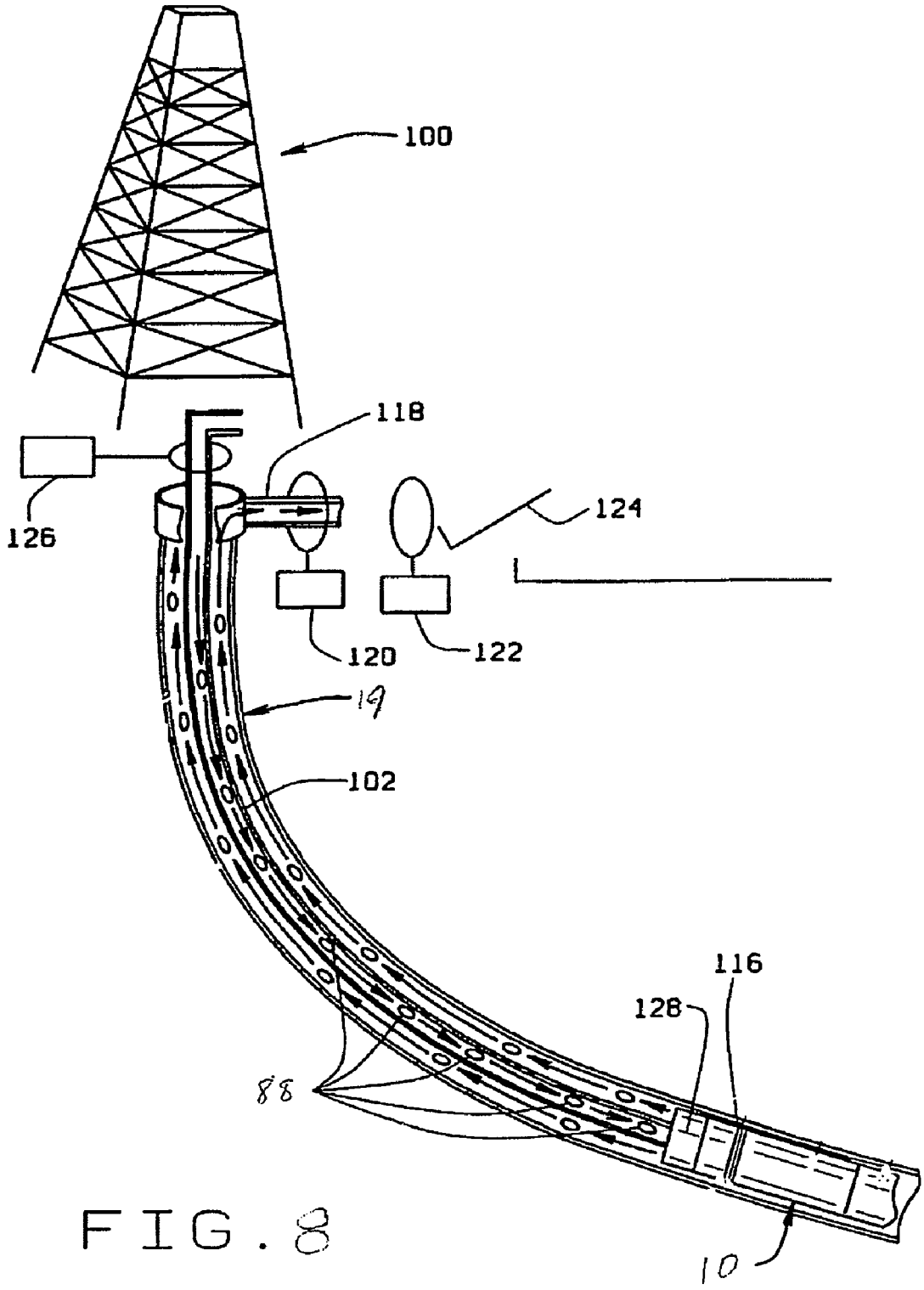
FIG. 8 is a schematic view of a well drilling system using any of the embodiments of the multipurpose downhole tool.

FIG. 8 illustrates a schematic view of a drilling rig incorporating the data carriers 88. The drilling rig includes a derrick 100 with a pipe string 102, which may be a drilling string, extending to the tool 10 in the borehole 19. Drilling mud or fluid is circulated down the pipe string 102 and returns in the borehole annulus surrounding the pipe string 102. Although FIG. 9 illustrates the tool 10 being on a drill string 102, the tool 10 may also be located on a wireline or a work string.

At least one data carrier 88 is circulated in the annulus fluid. Data may be written to the at least one data carrier 88 directly or remotely as described above with data from at least one of the sensors 48,50,52. Other downhole sensors may also write data to the at least one data carrier 88. For example, data related to formation pressure, porosity, and resistivity may be collected and written to the at least one data carrier 88. There may also be more than one data carrier 88 for transporting data from the sensors 48,50,52. The process of writing data may clear the memory of the data carrier 88, or a separate eraser 116 may be provided to clear previously recorded data. The at least one data carrier 88 may then be placed in the fluid conduit system 28 of the tool 10 and pumped out of the discharge line 38 into the annulus above the tool 10 in the borehole 19. The at least one data carrier 88 then flows with the drilling fluid back up the borehole 19 in the space surrounding the drilling string 102. At the top of the well the fluid is drawn off in a conduit 118. A data reader 120 may then read the data from the at least one data carrier 88. There may also be a data eraser 122 provided to erase the at least one data carrier 88 as it or they flow in the fluid through the conduit 118. A separator or shaker table 124 can collect the at least one data carrier 88 from the fluid for reuse.

The drilling rig 100 may also be configured for two way communication so that in addition to permitting information about the underground conditions to be communicated to the surface, instructions from the surface can be communicated to the tool 10. A data writer 126 can be provided at the surface for writing data to at least one data carrier 88 either before the at least one carrier 88 is introduced into the borehole fluid or after the at least one data carrier 88 is introduced into the fluid. The tool 10 would then also be provided with a data reader 128 to read the data on the at least one data carrier 88 as it or they reach the tool 10.

While specific embodiments have been illustrated and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. A multi-purpose downhole tool comprising:

packers for isolating an interval of a downhole formation traversed by a borehole to form a packed-off interval annulus;

a reversible pump;

more than one interval access port located between said packers providing fluid communication with fluid in the packed-off interval annulus;

a fluid conduit system comprising interval flowlines, each interval flowline associated with one of said interval access ports, said fluid conduit system providing fluid communication between said interval access ports and said reversible pump; and valves for controlling fluid communication between said interval access ports and said reversible pump.

2. The multi-purpose downhole tool of claim 1 where said tool is conveyable downhole on a wireline.

3. The multi-purpose downhole tool of claim 1 where said tool is conveyable downhole on a pipe string.

4. The multi-purpose downhole tool of claim 1 further comprising a sensor for obtaining a property of the fluid in said fluid conduit system.

5. The multi-purpose downhole tool of claim 1 where the interval access ports are spaced apart azimuthally within the borehole.

6. The multi-purpose downhole tool of claim 1 where the interval access ports are spaced apart axially within the borehole.

7. The multi-purpose downhole tool of claim 1 further comprising a fluid chamber, said reversible pump being able to move fluid between said fluid chamber and the packed-off interval annulus.

8. The multi-purpose downhole tool of claim 7 wherein said fluid chamber is releasably coupled to the downhole tool, is capable of collecting fluids, and is capable of being released from the downhole tool for retrieval at the surface.

9. The multi-purpose downhole tool of claim 1 further comprising more than one fluid chamber, said reversible pump being able to move fluid from one fluid chamber, through the packed-off interval annulus, and into another fluid chamber.

10. The multi-purpose downhole tool of claim 1 further comprising:

a writable and readable data carrier capable of flowing in a fluid flow;

a data writer capable of writing data to said data carrier; and a data reader capable of reading data from said data carrier.

11. The multi-purpose downhole tool of claim 1 wherein said reversible pump is operated by power supplied by at least one of surface power, a battery, and a generator.

12. A method comprising:

lowering a tool into a borehole;

sealing off an interval of the borehole with inflatable packers to form a packed-off interval annulus;

pumping fluid from the packed-off interval annulus with a reversible pump through a first interval access port located between said inflatable packers and into a first interval flowline; and pumping fluid from the packed-off interval annulus with said reversible pump through a second interval access port located between said inflatable packers and into a second interval flowline.

13. The method of claim 12 further comprising determining the pressure of the fluid in said first interval flowline.

14. The method of claim 12 further comprising determining the pressure of the fluid in said second interval flowline.

15. The method of claim 12 further comprising collecting fluid pumped into at least one of said first and second interval access ports into a fluid chamber.

16. The method of claim 15 further comprising:

releasing said fluid chamber from the downhole tool; and retrieving said fluid chamber to the surface.

17. The method of claim 12 further comprising pumping fluid into the interval with said reversible pump through at least one of said first and second interval access ports.

18. The method of claim 12 further comprising determining a property of the fluid in at least one of said first and second interval flowlines.

19. The method of claim 12 further comprising pumping a well enhancement fluid into the interval with said reversible pump.

20. The method of claim 12 further comprising:

providing a writable and readable data carrier capable of flowing in a fluid flow;

writing data to said data carrier with a data writer at a first location;

flowing said data carrier from said first location to a second location; and reading data from said data carrier with a data reader at said second location.

21. The method of claim 12 further comprising operating said reversible pump with power supplied by at least one of surface power, a battery, and a generator.

22. A method comprising:

lowering a tool into a borehole;

sealing off an interval of the borehole with inflatable packers to form a packed-off interval annulus;

pumping fluid from the packed-off interval annulus with a reversible pump through a first interval access port located between said inflatable packers and into a first interval flowline;

pumping fluid from the packed-off interval annulus with a reversible pump through a second interval access port located between said inflatable packers and into a second interval flowline; and pumping fluid with said reversible pump from a first fluid chamber, through the packed off interval annulus, and into a second fluid chamber.

23. The method of claim 22 further comprising determining the pressure of the fluid in said first interval flowline.

24. The method of claim 22 further comprising determining the pressure of the fluid in said second interval flowline.

25. The method of claim 22 further comprising collecting fluid pumped into at least one of said first and second interval access ports into at least one of said first and second fluid chambers.

26. The method of claim 25 further comprising:

releasing at least one of said first and second fluid chambers from the downhole tool; and retrieving at least one of said first and second fluid chambers to the surface.

27. The method of claim 22 where pumping fluid through the packed-off interval annulus comprises flowing fluid into the packed-off interval annulus through said first interval access port and out of the packed-off interval annulus through said second interval access port.

28. The method of claim 22 where pumping fluid through the packed-off interval annulus comprises flowing fluid into the packed-off interval annulus through said second interval access port and out of the packed-off interval annulus through said first interval access port.

29. The method of claim 22 further comprising controlling the flow of fluids through said first and second interval access ports using valves.

30. The method of claim 22 where said fluid in said first fluid chamber is a well enhancement fluid.

31. The method of claim 22 further comprising:

providing a writable and readable data carrier capable of flowing in a fluid flow;

writing data to said data carrier with a data writer at a first location;

flowing said data carrier from said first location to a second location; and reading data from said data carrier with a data reader at said second location.

32. The method of claim 22 further comprising operating said reversible pump with power supplied by at least one of surface power, a battery, and a generator.

* * * * *